US010738574B2

(12) United States Patent
Abdelfattah et al.

(10) Patent No.: US 10,738,574 B2
(45) Date of Patent: Aug. 11, 2020

(54) INFLOW PROMOTION ARRANGEMENT

(71) Applicants: Tarik Abdelfattah, Houston, TX (US); Jose Rafael Gonzalez, Fulshear, TX (US)

(72) Inventors: Tarik Abdelfattah, Houston, TX (US); Jose Rafael Gonzalez, Fulshear, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/104,722

(22) Filed: Aug. 17, 2018

(65) Prior Publication Data

US 2020/0056461 A1 Feb. 20, 2020

(51) Int. Cl.

| | |
|---|---|
| ***E21B 43/12*** | (2006.01) |
| ***E21B 43/14*** | (2006.01) |
| ***E21B 43/08*** | (2006.01) |

(52) U.S. Cl.

CPC ..... *E21B 43/121* (2013.01); *E21B 43/08* (2013.01); *E21B 43/14* (2013.01)

(58) Field of Classification Search

CPC ..... E21B 43/121; E21B 43/124; E21B 43/14

See application file for complete search history.

(56) References Cited

U.S. PATENT DOCUMENTS

| | | | | |
|---|---|---|---|---|
| 6,168,388 | B1 * | 1/2001 | Hughes | E21B 43/124 417/245 |
| 6,619,402 | B1 | 9/2003 | Amory et al. | |
| 2002/0139525 | A1 | 10/2002 | Erick | |
| 2010/0252271 | A1 * | 10/2010 | Kelley | E21B 43/122 166/370 |
| 2013/0220633 | A1 | 8/2013 | Felten | |
| 2015/0135849 | A1 | 5/2015 | Beg et al. | |
| 2016/0265315 | A1 | 9/2016 | Frosell et al. | |

OTHER PUBLICATIONS

Notification of Transmittal of the International Search Report and the Written Opinion of the International Searching Authority, or the Declaration; PCT/US2019/041298; dated Oct. 24, 2019; 10 pages.

* cited by examiner

*Primary Examiner* — Giovanna Wright
(74) *Attorney, Agent, or Firm* — Cantor Colburn LLP

(57) ABSTRACT

An inflow promotion arrangement including a housing; and a promotion configuration within the housing, the promotion configuration actuatable by fluid from a relatively higher productivity index zone of a wellbore.

20 Claims, 6 Drawing Sheets

INFLOW PROMOTION ARRANGEMENT

BACKGROUND

In the resource recovery industry, wellbores are created that penetrate subsurface formations that contain target fluids. Natural geology all but guarantees that various zones of the wellbore will have different productivity indexes depending upon such factors as particulate size in the sand or rock of the formation, permeability of the formation, motility of the target fluid reserve in various locations, etc. Efforts to maximize production have been focused upon drawdown pressures usually created by electric submersible pumps that pull a lower pressure in the wellbore than exists in the surrounding formation. This works admirably to increase production but also can contribute to early water breakthrough in higher productivity zones. Efforts to reduce the early breakthrough while maintaining the promise of higher production have focused upon various types of inflow control devices that are placed at the higher productivity zones to reduce flow rate from those zones in order to stave off early breakthrough. There has been good success with the concept and the art has occupied itself with the conception of all manner of inflow control devices. A downside though is that overall productivity is more tied to the lower productivity index zones than it is to the higher productivity zones. Since maximum production that is sustainable without early breakthrough is always the goal in resource recovery, the art would welcome alternatives that achieve that result.

SUMMARY

An inflow promotion arrangement including a housing; and a promotion configuration within the housing, the promotion configuration actuatable by fluid from a relatively higher productivity index zone of a wellbore.

A wellbore system including a relatively higher productivity index zone of the wellbore; a relatively lower productivity index zone of the wellbore; and an inflow promotion arrangement operably connected to the relatively higher productivity index zone and promotionally connected to the relatively lower productivity index zone.

A method for producing a wellbore including flowing a power fluid from a relatively higher productivity index zone of the wellbore fluid through an inflow promotion arrangement to power the inflow promotion arrangement; and promoting flow of fluid from a relatively lower productivity index zone of the wellbore with the inflow promotion arrangement.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
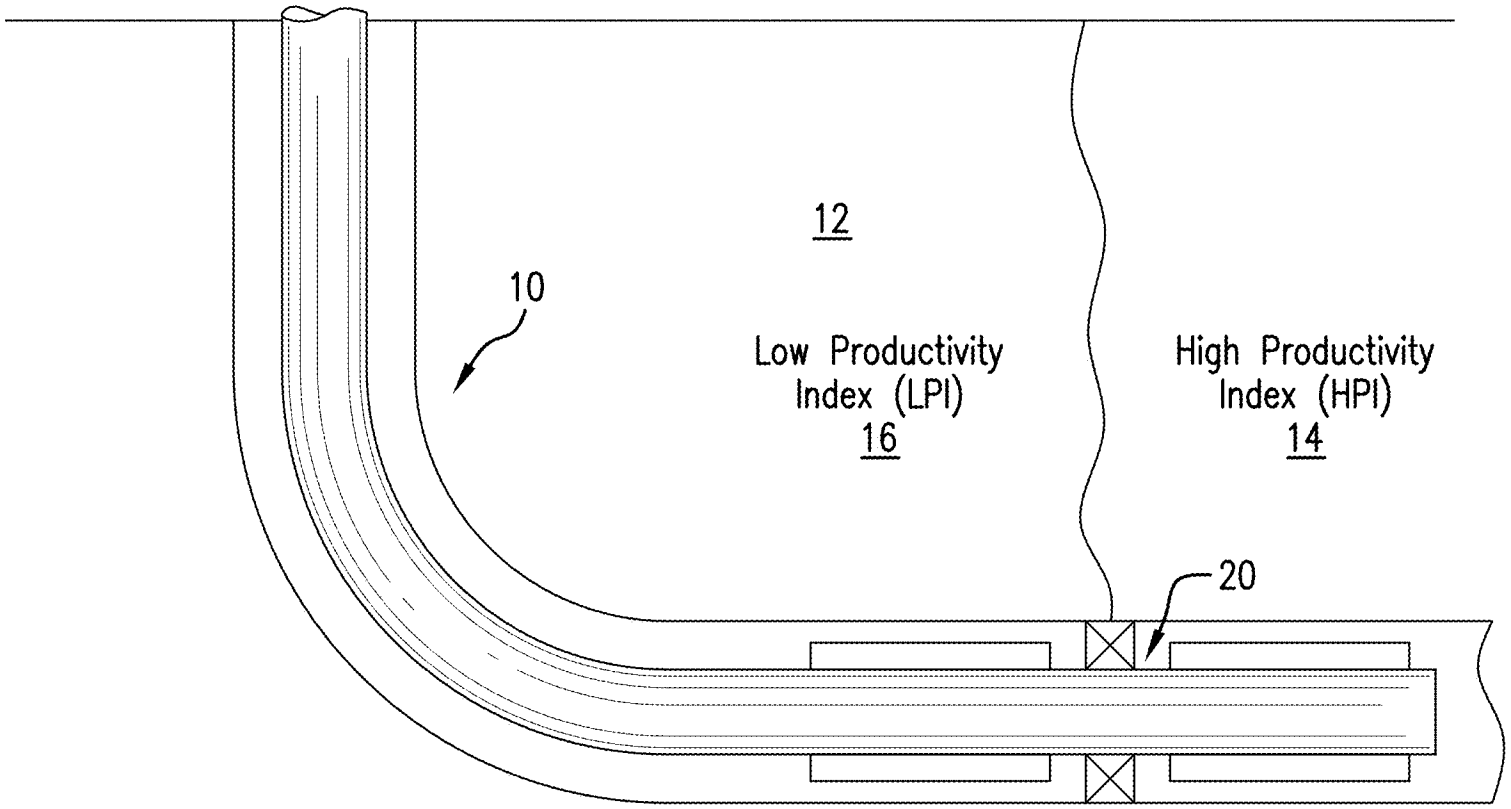
FIG. 1 is a schematic view of a wellbore having high and low productivity index (PI) zones.

Referring to FIG. 1, a wellbore 10 is illustrated penetrating a formation 12 having a relatively higher productivity (HPI) zone 14 and a relatively lower productivity (LPI) zone 16, separated by a seal 15, which may be a packer. It is to be understood that while the illustration only includes one of each zone, there may be many more zones of HPI or LPI or both and they may occur in any order along a length of the wellbore. LPI zones naturally will contribute less to the total volume of produced fluid from the wellbore 10. Inflow promotion arrangements as taught herein raise the actual production of the LPI zones to nearly the production capability of the HPI zones without increasing risk of early breakthrough in the HPI zones, increasing total production of the wellbore 10.

Figure 2:
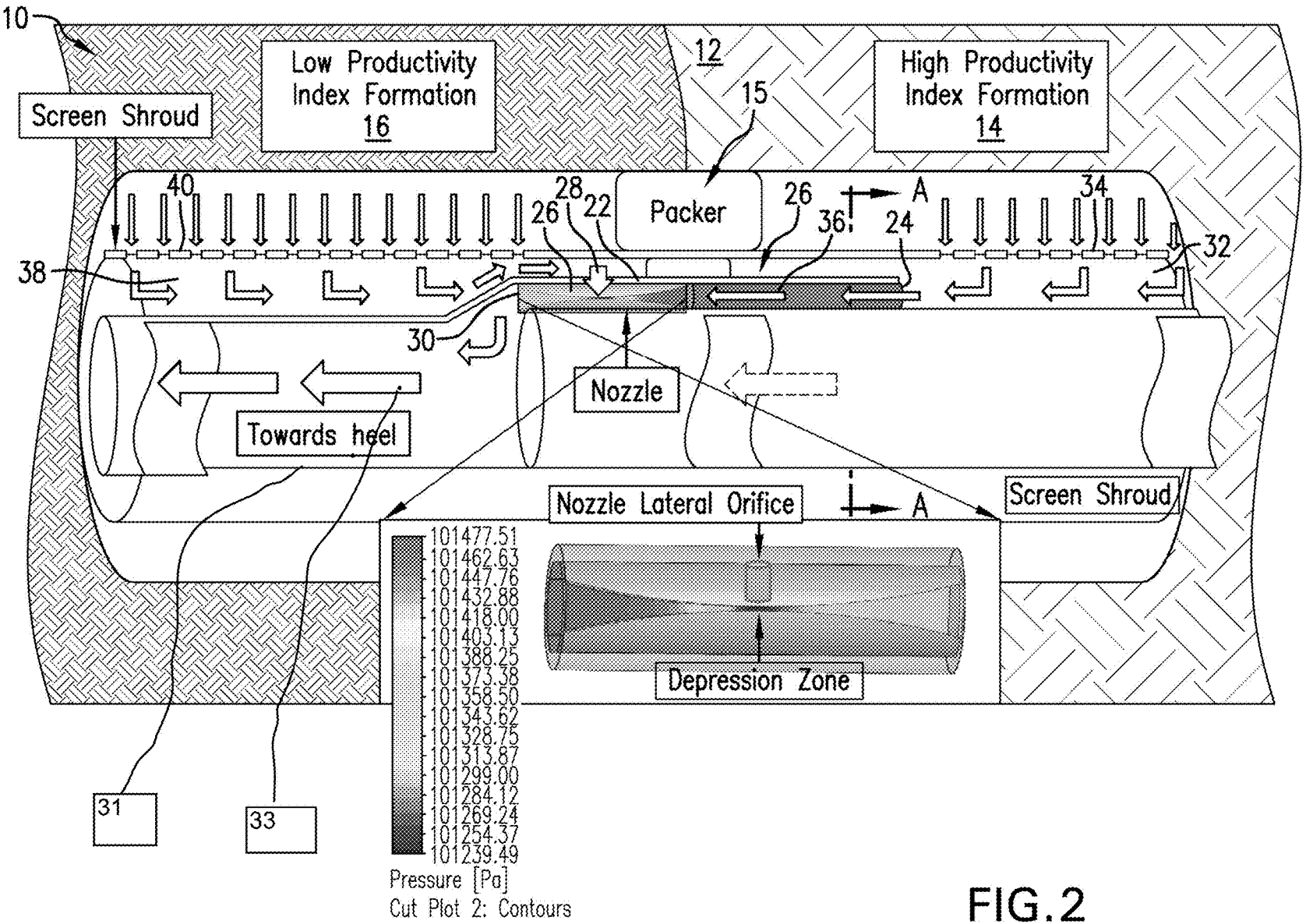
FIG. 2 is a cross sectional view of one embodiment of an inflow promotion arrangement for a well like FIG. 1 where the lower PI zone is uphole of the higher PI zone.
Figure 3:
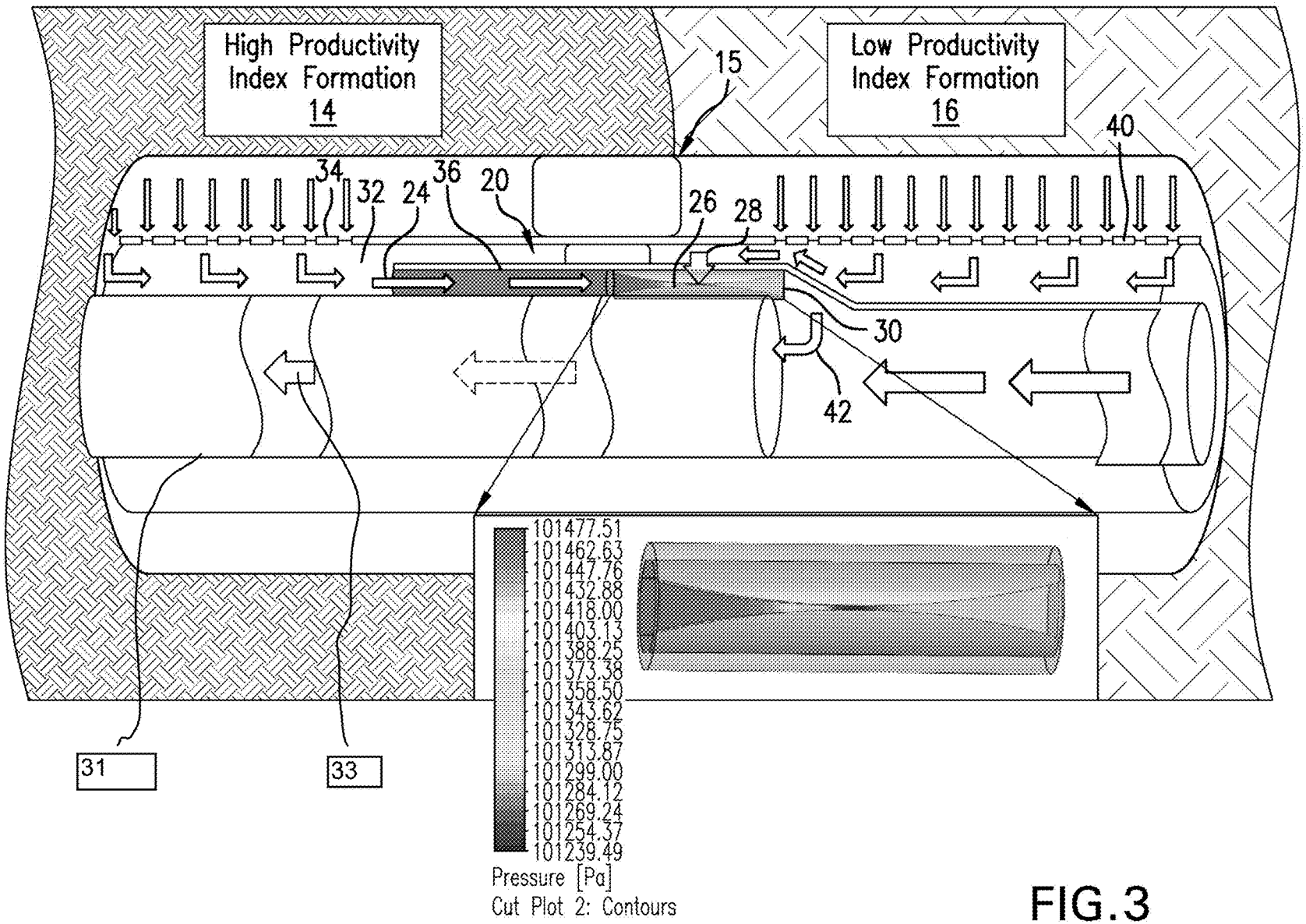
FIG. 3 is a cross sectional view of one embodiment of an inflow promotion arrangement for a well like FIG. 1 where the lower PI zone is downhole of the higher PI zone.
Figure 5:
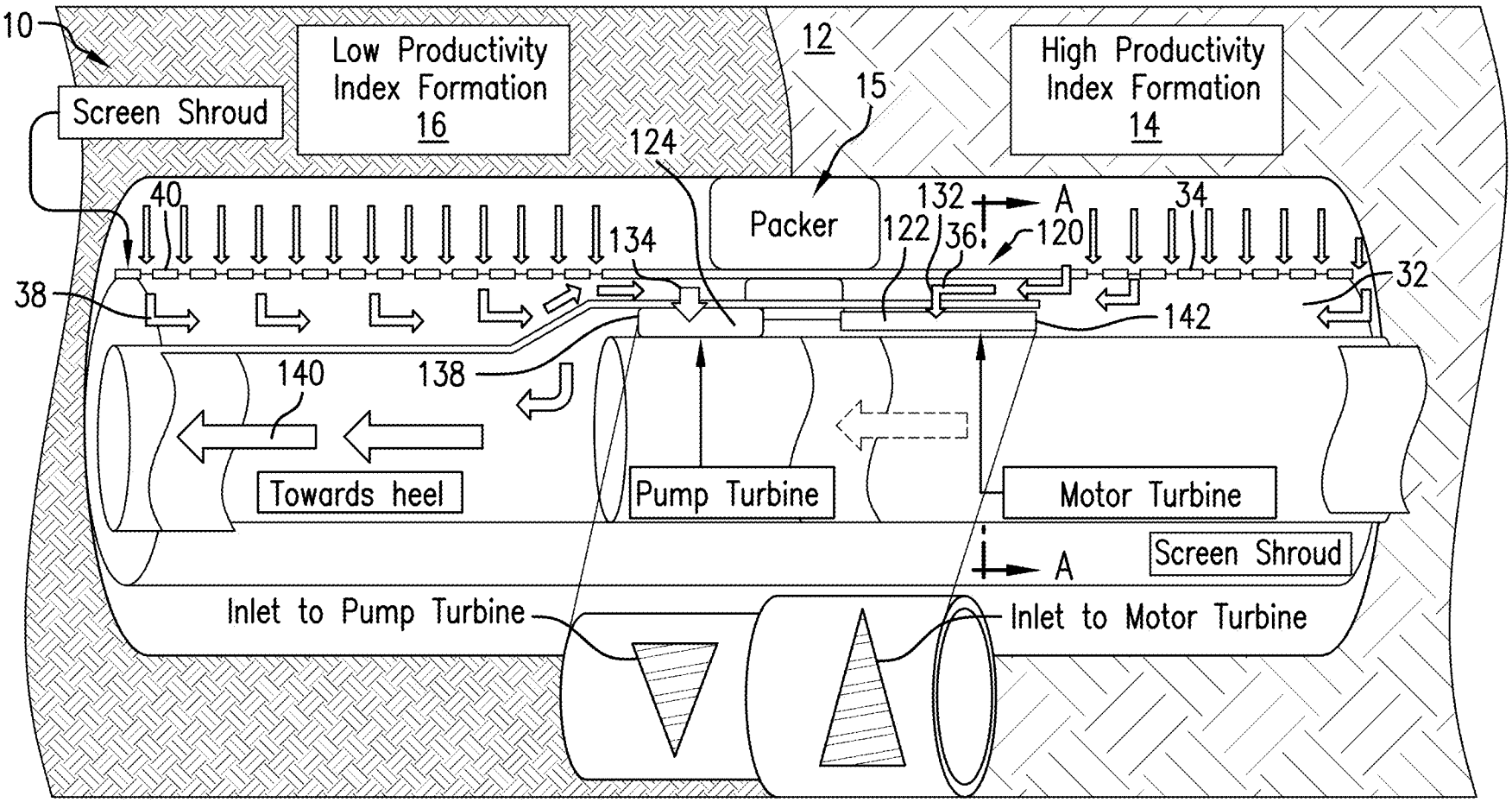
FIG. 5 is a cross sectional view of the embodiment of FIG. 4 where the lower PI zone is uphole of the higher PI zone.
Figure 6:
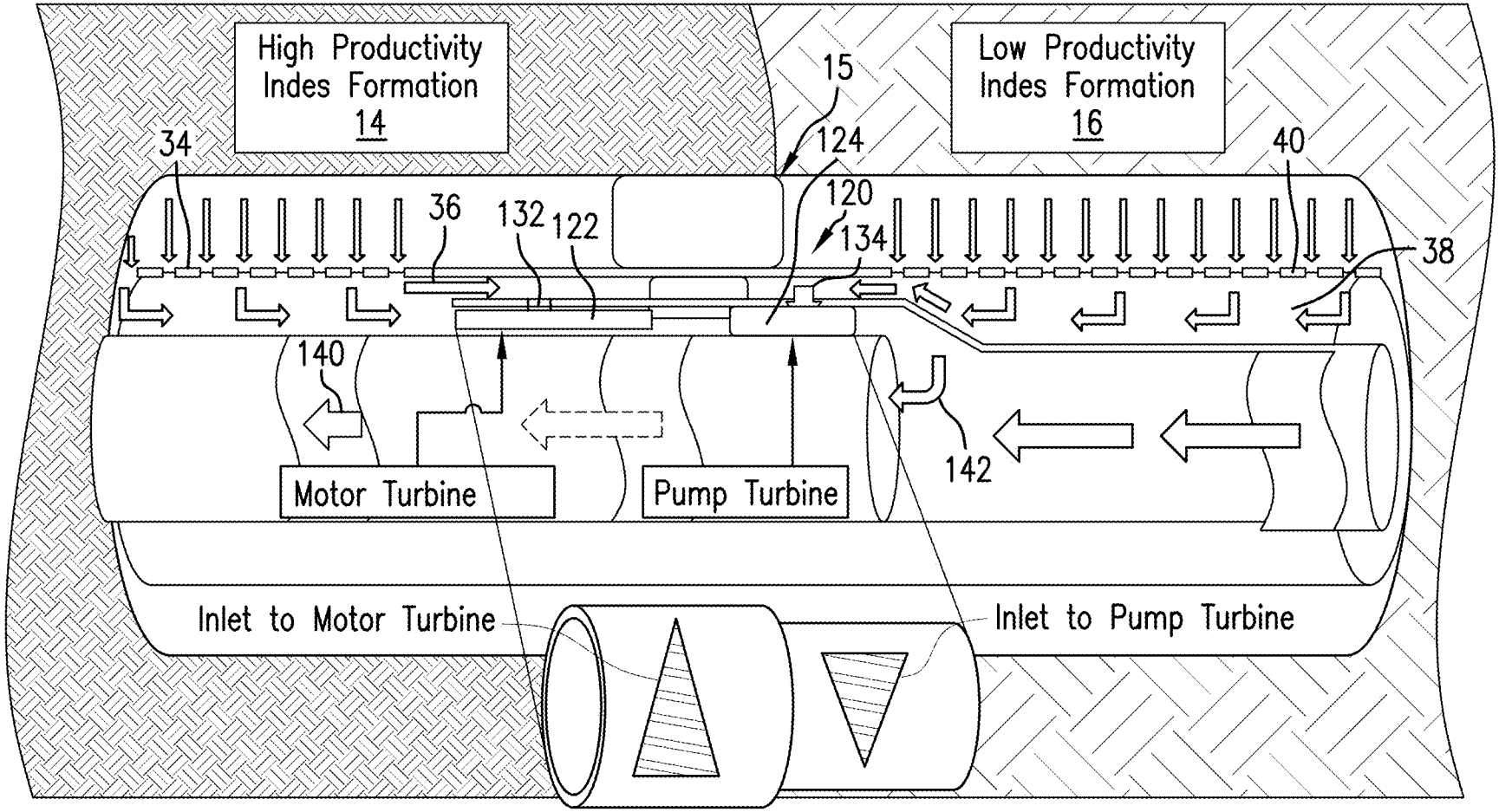
FIG. 6 is a cross sectional view of the embodiment of FIG. 4 where the lower PI zone is downhole of the higher PI zone.

FIGS. 2 and 3 represent one embodiment of an inflow promotion arrangement with FIG. 2 showing HPI and LPI zones in one order and FIG. 3 showing HPI and LPI zones in the reverse order. This is done to make apparent that the embodiment can be utilized regardless of order of HPI and LPI zones in the wellbore 10 with the same beneficial effect. Likewise FIGS. 5 and 6 illustrate another embodiment (shown in cross section in FIG. 4) of an inflow promotion arrangement with FIG. 5 showing HPI and LPI zones in one order and FIG. 6 showing HPI and LPI zones in the reverse order. This is again done to make apparent that the second embodiment can be utilized regardless of order of HPI and LPI zones in the wellbore 10 with the same beneficial effect. Each of the embodiments are responsive, in their own ways, to fluid properties from a relatively higher productivity zone 14 of a wellbore 10 to enhance flow of a fluid from a relatively lower productivity index zone 16 of the wellbore 10. Through employment of the inflow promotion arrangements taught herein, actual production from the relatively lower productivity index zone 16 is brought to near the potential level of production achievable from the higher productivity index zone 14. This is distinct from prior art constructions that use inflow control devices (ICD) at the HPI zones to restrict inflow therefrom. Through the use of the inflow promotion arrangements taught herein, the overall wellbore production rate is dictated more by the potential level of production from HPI zones 14 than from the lower potential level of production from the LPI zones 16 as is ICD technology. It is to be noted that oilfield convention is adhered to in the drawings such that leftward is uphole and rightward is downhole.

Referring to FIG. 2, a first embodiment of an inflow promotion arrangement 20 is illustrated. It will be appreciated that in FIG. 2, the LPI zone 16 is uphole of the HPI zone 14 within the wellbore 10 (in FIG. 3, these are reversed as mentioned above). The arrangement 20 in this embodiment includes a housing 22 having a power fluid inlet 24, a venturi tube 26 (inflow promotion configuration), a draw inlet 28 and a joint outlet 30. The power fluid inlet is fluidly operably connected to an annular flow area 32 defined by a filter 34 (though it is not necessarily required to have a filter and not necessarily germane to the inflow promotion arrangement 20, reduction of erosion in wellbore components and reduction in the chances of plugging the venturi tube 26 suggests the benefit of employing a screen). It is to be appreciated that the filter 34 may be of any conventional filtration arrangement including but not limited to conventional screens, premium screens, memory polymer screens, bead screens, etc. "Operably connected" is intended to have additional meaning in this context in that the fluid operates the arrangement 20. "Promotionally connected" is intended to mean that the fluid connected to the draw inlet 28 is promoted regarding its flow or in other words made to flow more prodigiously. In any event, the fluid flowing in the annulus 32 is collected from the HPI zone 14 meaning that the fluid is at a higher pressure or otherwise will flow more quickly into the wellbore 10 than the fluid from the LPI zone 16. Due to the additional energy of this fluid and the use made of it in the embodiments hereof, the fluid is termed herein "power fluid" 36. Energy is harvested from the power fluid 36 in the arrangement 20 by directing the power fluid 34 into the venturi tube 26. As will be understood by those of ordinary skill in this art and historically from Italian physicist Giovanni Venturi and Swiss mathematician Daniel Bernoulli, the power fluid will attain a lower pressure within the venturi tube 26. Since draw inlet 28 is configured to intersect the venturi tube 26, fluid will be drawn through the draw inlet 28 into the venturi tube 26 and expelled with the power fluid 36 from the joint outlet 30 into a main flow pathway 31 with flow direction shown by arrows 33. The draw inlet 28 is fed fluid from the LPI zone 16 through an annular space 38 defined by a filter 40 (with the same caveat regarding lack of necessity of the filter 40 as of filter 34). It is to be appreciated that the filter 40 may be of any conventional filtration arrangement including but not limited to conventional screens, premium screens, memory polymer screens, bead screens, etc. and additionally may be different than filter 34. Because this fluid is subjected to the lower pressure generated in the venturi tube 26, its flow rate is promoted. Through the operation of the arrangement 20, the LPI zone 16 produces nearly as much fluid as the HPI zone 14.

Referring to FIG. 3, with the reverse condition of the HPI zone being uphole of the LPI zone, the arrangement 20 is again illustrated simply to make clear the fluid pathways and directions. The arrangement 20 is identical as are all of its working parts. It is simply a mirror image of the FIG. 2 illustration with the distinctions being the locations of the HPI and LPI zones and that the joint fluid 30 must turn around at 42 to head uphole for production.

Figure 4:
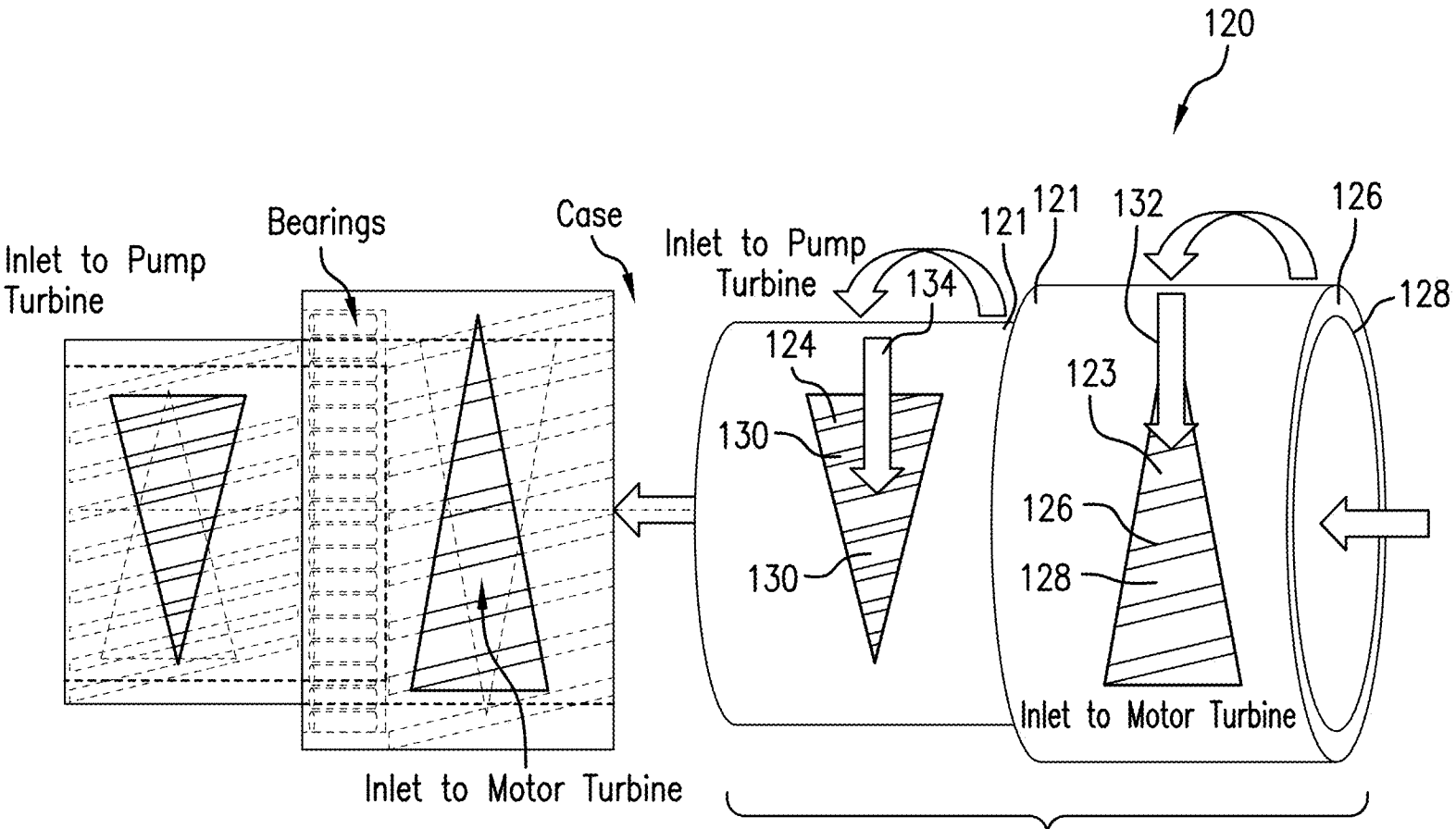
FIG. 4 is a schematic illustration of a second embodiment of inflow promotion arrangement as disclosed herein

Referring to FIG. 4, another embodiment of an inflow promotion arrangement 120 is schematically illustrated. Arrangement 120 includes housing 121, and an alternate promotion configuration illustrated as a turbine system 122 comprising a drive turbine 123 and a driven turbine 124 (the turbines being the inflow promotion configuration for the embodiment). In an iteration a "Pelton" configuration of blades 126 around a runner 128 is employed for the drive turbine while an impeller vane configuration 130 is employed in the driven turbine 124. The arrangement also includes a power fluid inlet 132, a draw inlet 134. The power fluid and draw fluid may be commingled within the arrangement 120 and output through outlet 138 or the power fluid may be maintained separate from the draw fluid and output to the production stream 140 through an optional outlet 142. Power fluid 36 supplied to the drive turbine 123 causes that turbine to spin which in turn causes the driven turbine 124 to spin. The driven turbine 124 is configured as an impeller and therefore draws fluid from draw inlet 134 and pumps that fluid into the production stream 140. As in the foregoing embodiment, energy from the HPI zone 14 is used to promote production from the LPI zone 16.

Referring to FIG. 5, an iteration where a HPI zone 14 is downhole of an LPI zone 16 illustrated. Other than the arrangement 1:20 whose components are identified above, the configuration in use is very similar to the foregoing embodiment 20. The power fluid 36 is supplied from the HPI zone 14 through annulus 32 into the power fluid inlet 132. The promoted fluid is taken from the LPI zone 16 and fed to draw inlet 134.

Referring to FIG. 6, the reader will appreciate a significant similarity to FIG. 3 in that FIG. 6 is a mirror image of FIG. 5 except that the produced fluid through arrangement 120 will make a turn at 142 to enter the production stream.

Set forth below are some embodiments of the foregoing disclosure:

Embodiment 1

An inflow promotion arrangement including a housing; and a promotion configuration within the housing, the promotion configuration actuatable by fluid from a relatively higher productivity index zone of a wellbore.

Embodiment 2

The arrangement as in any prior embodiment further comprising a power fluid inlet.

Embodiment 3

The arrangement as in any prior embodiment further comprising a draw inlet.

Embodiment 4

The arrangement as in any prior embodiment further comprising a joint outlet.

Embodiment 5

The arrangement as in any prior embodiment wherein the power fluid is a fluid from the relatively higher productivity index zone.

Embodiment 6

The arrangement as in any prior embodiment wherein the power fluid inlet is connected to the promotion configuration.

Embodiment 7

The arrangement as in any prior embodiment wherein the promotion configuration is a venturi tube.

Embodiment 8

The arrangement as in any prior embodiment wherein the promotion configuration is a turbine system.

Embodiment 9

The arrangement as in any prior embodiment wherein the turbine system includes a drive turbine and a driven turbine.

Embodiment 10

The arrangement as in any prior embodiment wherein the driven turbine is an impeller.

Embodiment 11

A wellbore system including a relatively higher productivity index zone of the wellbore; a relatively lower productivity index zone of the wellbore; and an inflow promotion arrangement operably connected to the relatively higher productivity index zone and promotionally connected to the relatively lower productivity index zone.

Embodiment 12

The wellbore system as in any prior embodiment further including a filter.

Embodiment 13

The wellbore system as in any prior embodiment wherein the filter comprises a screen.

Embodiment 14

The wellbore system as in any prior embodiment wherein the inflow promotion arrangement includes a housing; and a promotion configuration within the housing, the promotion configuration actuatable by fluid from a relatively higher productivity index zone of a wellbore.

Embodiment 15

The wellbore system as in any prior embodiment wherein the inflow promotion arrangement includes a power fluid inlet fluidly connected to the relatively higher productivity index zone.

Embodiment 16

The arrangement as in any prior embodiment wherein the promotion configuration is a venturi tube.

Embodiment 17

The arrangement as in any prior embodiment wherein the promotion configuration is a turbine system.

Embodiment 18

A method for producing a wellbore including flowing a power fluid from a relatively higher productivity index zone of the wellbore fluid through an inflow promotion arrangement to power the inflow promotion arrangement; and promoting flow of fluid from a relatively lower productivity index zone of the wellbore with the inflow promotion arrangement.

Embodiment 19

The method as in any prior embodiment wherein the power fluid flows through a venturi tube creating a low pressure at a draw inlet and drawing fluid into the inflow promotion arrangement.

Embodiment 20

The method as in any prior embodiment wherein the power fluid flows through a turbine system creating a low pressure at a draw inlet and drawing fluid into the inflow promotion arrangement.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An inflow promotion arrangement comprising: a housing defining a main flow pathway; and a promotion configuration within the housing, outside of the main flow pathway and between the main flow pathway and a formation in which the inflow promotion arrangement is disposed during use, the promotion configuration actuatable by fluid from a relatively higher productivity index zone of a wellbore the promotion configuration operable to enhance production flow rate from a relatively lower productivity index zone to nearer a potential level of production flow rate achievable from the higher productivity index zone.

2. The arrangement as claimed in claim 1 further comprising a power fluid inlet.

3. The arrangement as claimed in claim 1 further comprising a draw inlet.

4. The arrangement as claimed in claim 1 further comprising a joint outlet.

5. The arrangement as claimed in claim 2 wherein the power fluid is a fluid from the relatively higher productivity index zone.

6. The arrangement as claimed in claim 2 wherein the power fluid inlet is connected to the promotion configuration.

7. The arrangement as claimed in claim 1 wherein the promotion configuration is a venturi tube.

8. The arrangement as claimed in claim 1 wherein the promotion configuration is a turbine system.

9. The arrangement as claimed in claim 8 wherein the turbine system includes a drive turbine and a driven turbine.

10. The arrangement as claimed in claim 9 wherein the driven turbine is an impeller.

11. A wellbore system comprising: a relatively higher productivity index zone of the wellbore; a relatively lower productivity index zone of the wellbore; and an inflow promotion arrangement outside of a main flow pathway and between the main flow pathway and a formation in which the inflow promotion arrangement is disposed during use, the inflow promotion arrangement operably connected to the relatively higher productivity index zone and promotionally connected to the relatively lower productivity index zone, the promotion arrangement enhancing production flow rate from a relatively lower productivity index zone to nearer a potential level of production flow rate achievable from the higher productivity index zone.

12. The wellbore system as claimed in claim 11 further comprising a filter.

13. The wellbore system as claimed in claim 12 wherein the filter comprises a screen.

14. A housing; and a promotion configuration within the housing, the promotion configuration outside of a main flow pathway and between the main flow pathway and a formation in which the promotion configuration is disposed during use, the promotion configuration actuatable by fluid from a relatively higher productivity index zone of a wellbore to promote production flow from a lower productivity index zone of the wellbore.

15. The wellbore system as claimed in claim 14 wherein the inflow promotion arrangement includes a power fluid inlet fluidly connected to the relatively higher productivity index zone.

16. The arrangement as claimed in claim 14 wherein the promotion configuration is a venturi tube.

17. The arrangement as claimed in claim 14 wherein the promotion configuration is a turbine system.

18. A method for producing a wellbore comprising: flowing a power fluid from a relatively higher productivity index zone of the wellbore fluid through an inflow promotion arrangement outside of a main flow pathway and between the main flow pathway and a formation in which the inflow promotion arrangement is disposed during use, to power the inflow promotion arrangement; and promoting flow of fluid from a relatively lower productivity index zone of the wellbore with the inflow promotion arrangement thereby enhancing production flow rate from a relatively lower productivity index zone to nearer a potential level of production flow rate achievable from the higher productivity index zone.

19. The method as claimed in claim 18 wherein the power fluid flows through a venturi tube creating a low pressure at a draw inlet and drawing fluid into the inflow promotion arrangement.

20. The method as claimed in claim 18 wherein the power fluid flows through a turbine system creating a low pressure at a draw inlet and drawing fluid into the inflow promotion arrangement.

* * * * *